US006488541B1

(12) United States Patent
Takeuchi

(10) Patent No.: US 6,488,541 B1
(45) Date of Patent: Dec. 3, 2002

(54) CONNECTOR

(75) Inventor: Shinobu Takeuchi, Koriyama (JP)

(73) Assignee: Moldec Co., Ltd., Fukushima (JP)

( * ) Notice: Subject to any disclaimer, the term of this patent is extended or adjusted under 35 U.S.C. 154(b) by 0 days.

(21) Appl. No.: 09/926,255

(22) PCT Filed: Apr. 3, 2000

(86) PCT No.: PCT/JP00/02157

§ 371 (c)(1),
(2), (4) Date: Oct. 2, 2001

(87) PCT Pub. No.: WO00/60702

PCT Pub. Date: Oct. 12, 2000

(30) Foreign Application Priority Data

Apr. 5, 1999 (JP) ..... 11-134639
Oct. 12, 1999 (JP) ..... 11-290154

(51) Int. Cl.[7] ..... H01R 24/00
(52) U.S. Cl. ..... 439/660; 439/752
(58) Field of Search ..... 439/79, 752, 701, 439/901, 660

(56) References Cited

U.S. PATENT DOCUMENTS 5,580,283 A * 12/1996 O'Sullivan et al. ..... 439/686
5,975,917 A * 11/1999 Wang et al. ..... 439/79

FOREIGN PATENT DOCUMENTS

FR 2 376 532 7/1978

* cited by examiner

*Primary Examiner*—Tho D. Ta
*Assistant Examiner*—James R. Harvey
(74) *Attorney, Agent, or Firm*—Paul A. Guss

(57) ABSTRACT

There is provided a connector which allows the hood of a case thereof to be corrected out of a distortion that the hood is suffering, and hence which can easily be connected to another connector. The hood 6 of a receptacle connector, for example, is corrected out of an inward distortion at its center which has been caused when the case 2 is placed alone as shown in FIG. 6(*a*). First, a pair of upper and lower reception contacts 3 is inserted into through holes 7 defined in a body 5 of a case 2 until the reception contacts 3 are brought into contact with upper and lower inner wall surfaces of the body 5. Then, as shown in FIG. 6(*b*), a fitting member 4 whose thickness is larger in its front portion than in its rear portion is inserted between the upper and lower reception contacts 3, and fitted into the body 5. Then, as shown in FIG. 6(*c*), the front portion of the body 5 is spread, correcting a front end portion of the hood 6 into a normal state.

10 Claims, 7 Drawing Sheets

CONNECTOR

TECHNICAL FIELD

The present invention relates to a connector for use with a cable which connects a circuit board used in a personal computer or the like or a personal computer or the like to a peripheral device.

BACKGROUND ART

Connectors for use with cables which connect circuit boards used in personal computers or the like or personal computers or the like to peripheral devices include a plug connector as a male connector and a receptacle connector as a female connector. The receptacle connector comprises reception contacts that are generally made of a conductor and a case made of insulating synthetic resin and housing the reception contacts fixed therein. The case has a body to which the contacts are fixed and a tubular hood extending forward from the body. The plug connector also has a case made of insulating synthetic resin as with the receptacle connector, and also includes insertion contacts fixed to the case with an intermediate member sandwiched between the contacts and the case.

Since the case of each of the connectors is generally molded of insulating synthetic resin by a mold, the hood may possibly be contracted inwardly as shown in FIG. 6(*a*) of the accompanying drawings or spread outwardly as shown in FIG. 10(*a*) of the accompanying drawings when the synthetic resin shrinks after the case has been molded.

If the hood of one of the connectors is distorted, then the distorted hood interferes with the hood of the other connector when the connector is connected to the other connector, making it difficult for the connectors to be connected to each other.

It is an object of the present invention to provide an improved connector, and more specifically to provide a connector which allows the hood of a case thereof to be corrected out of a distortion that the hood is suffering, and hence which can easily be connected to another connector.

DISCLOSURE OF THE INVENTION

To achieve the above object, there is provided in accordance with a first aspect of the present invention A receptacle connector for connection to a plug connector, characterized by a case of insulating synthetic resin comprising a body having a plurality of through holes extending from a front face to a rear face thereof and arranged transversely, and a tubular hood projecting forward from the body, being open in its front face, and having an interior communicating with said through holes, a pair of upper and lower reception contacts made of a conductor, inserted in said through holes, and arranged along upper and lower inner wall surfaces of said hood, and a fitting member fitted in said body between the upper and lower reception contacts and fixing said contacts to said case, wherein when said hood is distorted, the fitting member having a cross-sectional shape corresponding to the distortion of the hood is installed to deform said body to correct said hood out of the distortion.

According to a second aspect of the present invention, there is also provided a plug connector for connection to a receptacle connector, characterized by a case of insulating synthetic resin comprising a body having a pair of upper and lower through holes extending from a front face to a rear face thereof and arranged transversely, a tubular hood projecting forward from the body, being open in its front face, and having an interior communicating with said through holes, and an intermediately member projecting from said body into said hood and separating an interior of the hood into upper and lower spaces, a pair of upper and lower insertion contacts made of a conductor, inserted in said through holes and arranged along upper and lower surfaces of said intermediate member, and a pair of upper and lower fitting members fitted between said insertion contacts and said body and fixing said contacts to said case, wherein when said hood is distorted, the fitting member having a cross-sectional shape corresponding to the distortion of the hood is installed to deform said body to correct said hood out of the distortion.

With the connectors according to the first and second aspects, even if the hood of the case is distorted, the fitting member deforms the body to correct the hood out of the distortion, thus shaping the hood into a distortion-free state. When the connectors are connected to each other, they can easily be connected to each other because the hood of one of the connectors does not interfere with the hood of the other connector.

Preferably, said fitting member comprises members corresponding to the distortion of said hood which are selected from a plurality of members having different cross-sectional shapes and assembled transversely together.

The case is often distorted differently if a different mold is used to mold the case. With the connectors according to the present invention, even when a different mold is used to mold the case with a different distortion, since members corresponding to the distortion of the case can be selected and assembled into the fitting member, the case can easily be corrected out of the distortion without producing a new fitting member corresponding to the distortion of the case.

BEST MODE FOR CARRYING OUT THE INVENTION

Figure 1:
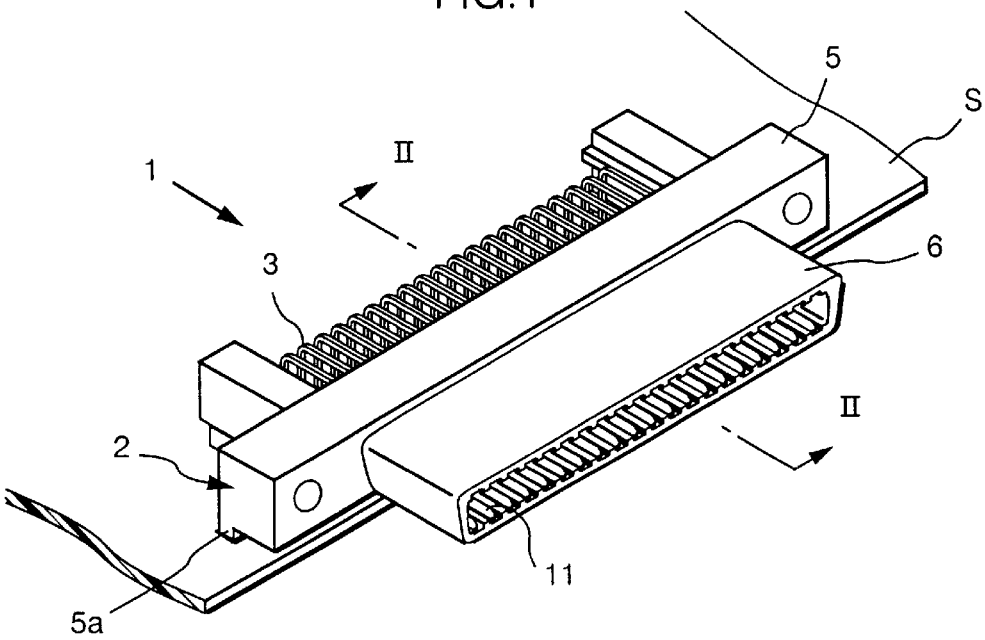
FIG. 1 is a view showing a receptacle connector according to a first embodiment of the present invention which is mounted on a circuit board.
Figure 2:
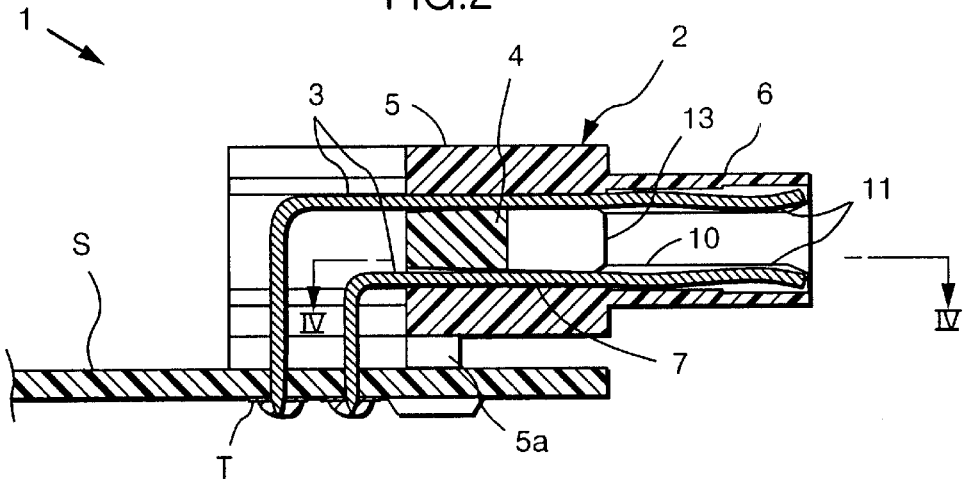
FIG. 2 is a cross-sectional view taken along II—II of FIG. 1.

Embodiments of connectors according to the present invention will be described below with reference to FIGS. 1 through 10(*a*)–10(*c*). First, a receptacle connector 1 according to a first embodiment of the present invention will be described below. As shown in FIG. 1, the receptacle connector 1 mounted on a circuit board S and has a case 2 and reception contacts 3. As shown in FIG. 2, a fitting member 4 is fitted in the case 2.

Figure 3:
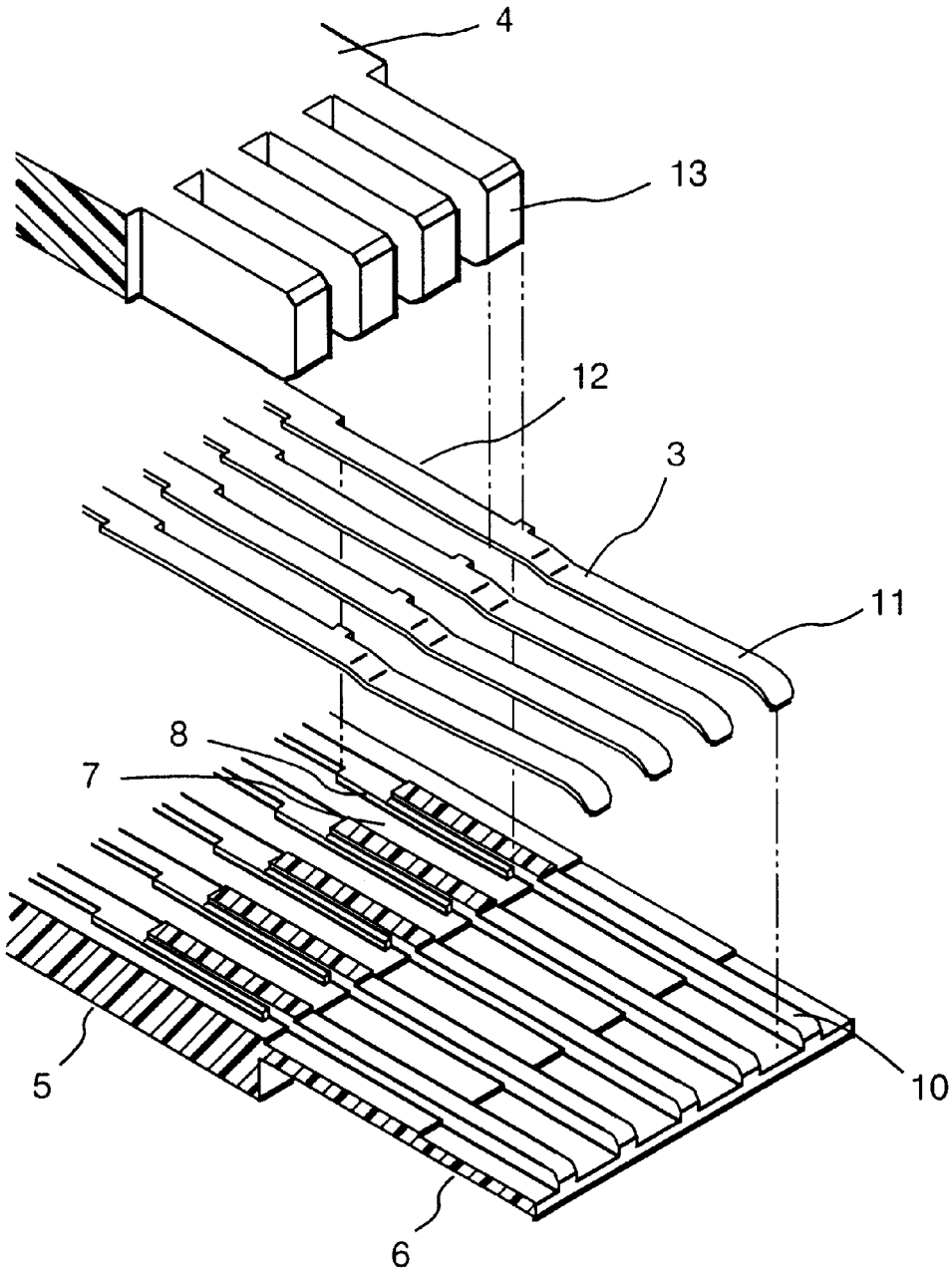
FIG. 3 is a view showing an internal structure of the receptacle connector according to the first embodiment.

The case 2 is molded of insulating synthetic resin injected into a mold (not shown). The case 2 comprises a body 5 with the reception contacts 3 fixed therein and a hood 6 projecting forward from the body 5. As shown in FIG. 2, the body 5 has through holes 7 defined therein through which the reception contacts 3 extend. As shown in FIG. 3, the body 5 has engaging protrusions 8 for engaging engaging members 12 of the reception contacts 3 which will be described later on. The body 5 has legs 5*a* on its opposite ends for fixing the case 2 to the circuit board S. The hood 6 is of a laterally elongate tubular form which is open in its front face. As shown in FIG. 3, the hood 6 has partitions 10 on its inner peripheral surface, each for keeping one of the reception contacts 3 out of contact with adjacent reception contacts 3.

The reception contacts 3 are blanked out of a sheet of copper alloy which is a conductor, by a press. As shown in FIGS. 2 and 3, the reception contacts 3 have respective contact members 11 in the vicinity of their tip ends for contact with insertion contacts of a plug connector. The reception contacts 3 also have engaging members 12 in their intermediate portions for engaging the engaging protrusions 8 of the body 5. The reception contacts 3 have respective rear ends soldered to terminals T on the circuit board S.

Figure 4:
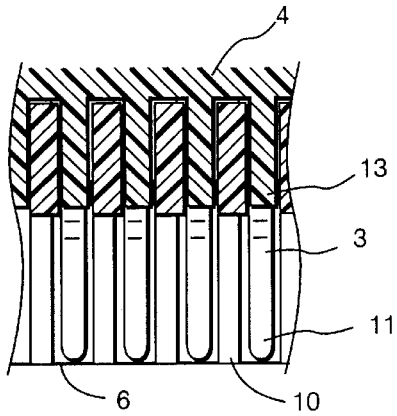
FIG. 4 is a partial cross-sectional view taken along IV—IV of FIG. 2.
Figure 5:
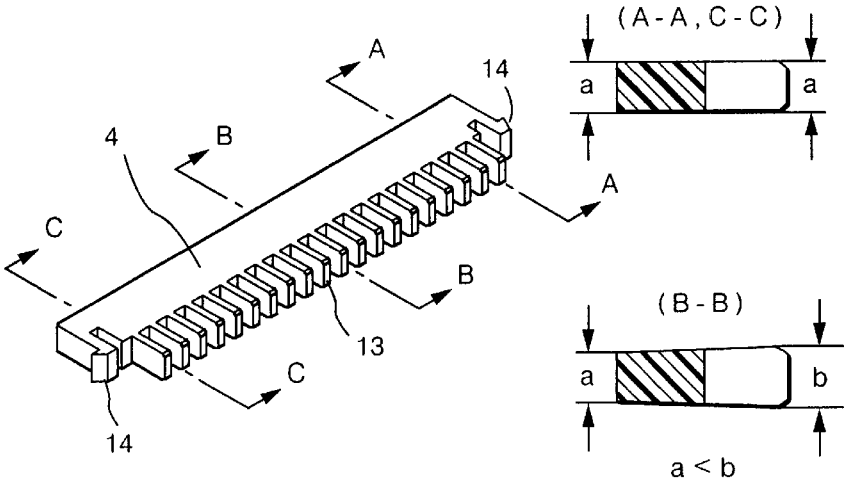
FIG. 5 is a set of views showing an external shape and cross-sectional shapes of a fitting member.

As shown in FIG. 2, a fitting member 4 has teeth 13 on its front end which are inserted in the through holes 7 in the case 2. As shown in FIG. 4, the teeth 13 are inserted within the through holes 7, fixing the contacts 3 to the body 5. The teeth 13 have cross-sectional shapes corresponding to distortions of the case 2. Specifically, the teeth 13 near the opposite ends of the fitting member 4 have equal front and rear thicknesses, as shown in the cross-sectional views taken along lines A—A and C—C of FIG. 5, whereas the teeth 13 at the center of the fitting member 4 have an increased front thickness as shown in the cross-sectional view taken along line B—B of FIG. 5. The fitting member 4 has upper and lower corners beveled on its tip end, and also has hooks 14 on its opposite ends for engaging in engaging recesses(not shown) defined in the case 2 when the fitting member 4 is fitted in the case 2.

Figure 6A:
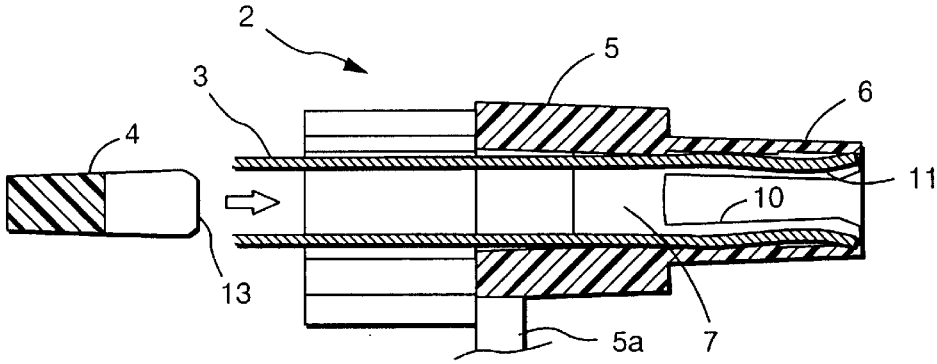
FIGS. 6(*a*) through 6(*c*) are views showing the manner in which the receptacle connector according to the first embodiment is assembled.
Figure 6B:
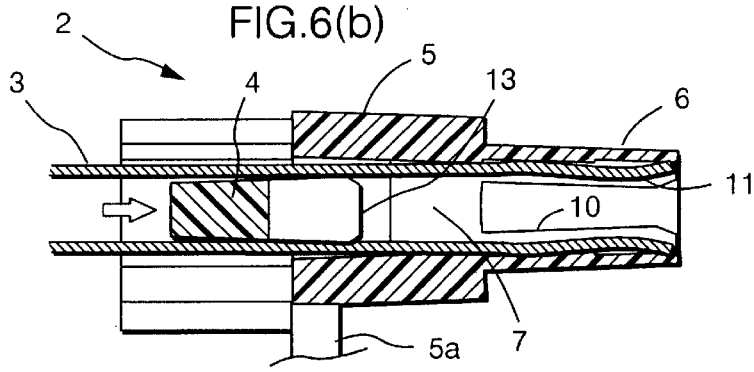
Figure 6C:
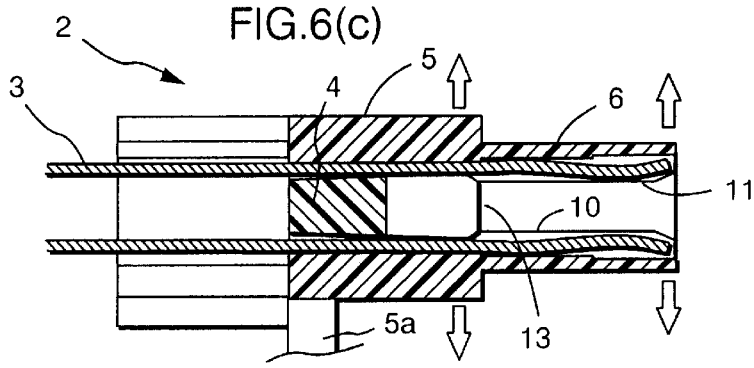

A process of correcting the hood 6 out of an inward distortion at its center which has been caused when the case 2 is placed alone as shown in FIG. 6(*a*) will be described below.

For assembling the receptacle connector 1 according to the present embodiment, as shown in FIG. 6(*a*), the reception contacts 3 are inserted into the through holes 7 in the case 2. The upper reception contacts 3 are brought into contact with an upper inner wall surface of the case 2, and the lower reception contacts 3 are brought into contact with a lower inner wall surface of the case 2. The engaging members 12 of the reception contacts 3 are engaged by the engaging protrusions 8 in the case 2. Then, as shown in FIG. 6(*b*), the fitting member 4 is inserted between the upper and lower reception contacts 3, and fitted into the body 5. At this time, since the tip end of the fitting member 4 is beveled, the fitting member 4 can smoothly be inserted into the case 2.

When the fitting member 4 is fully fitted in the case 2, as shown in FIG. 6(*c*), the teeth 13 of the fitting member 4 move into the through holes 7 until the hooks 14 on the opposite ends of the fitting member 4 engage in the fitting recesses(not shown) in the case 2. With the fitting member 4 being thus fitted in the body 5, the front portion of the body 5 is spread by the fitting member 4, correcting the contracted hood 6 into a normal state. In the present embodiment, the fitting member 4 has the teeth 13 for insertion into the through holes 7, and the teeth 13 allow vertically opening forces to be transmitted easily to the hood 6 for thereby reliably correcting the hood 6.

Since the fitting member 4 of the receptacle connector 1 according to the present embodiment has a shape complementary to the distortion of the case 2, the case 2 can be corrected out of the distortion wen the fitting member 4 is fitted into the case 2 to deform the body 5.

In the present embodiment, the fitting member 4 of synthetic resin is inserted into the case 2 after the reception contacts 3 of metal have been inserted into the case 2. Therefore, when the fitting member 4 is inserted, even if the fitting member 4 is cut off by the reception contacts 3, producing chips, the chips do not reach the contact members 11 of the reception contacts 3, and will not bring about a contact failure.

Figure 7:
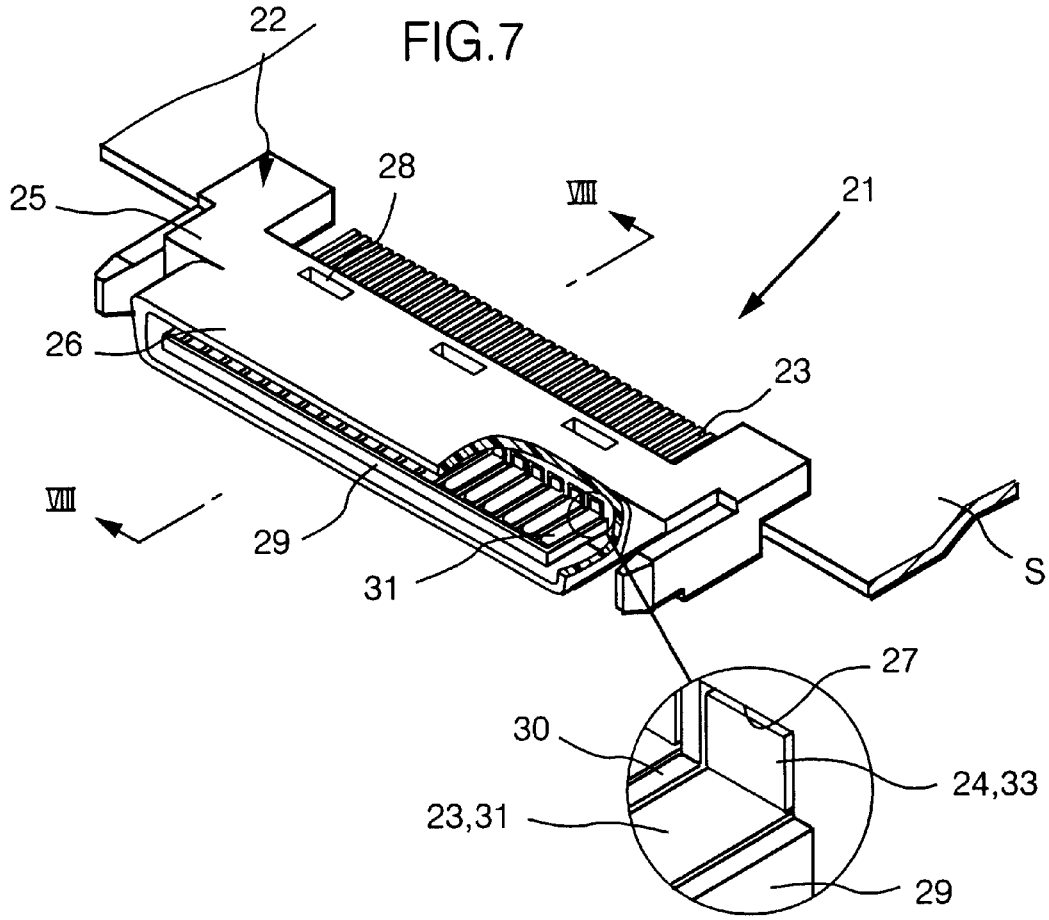
FIG. 7 is a view showing a plug connector according to a second embodiment of the present invention which is mounted on a circuit board.
Figure 8:
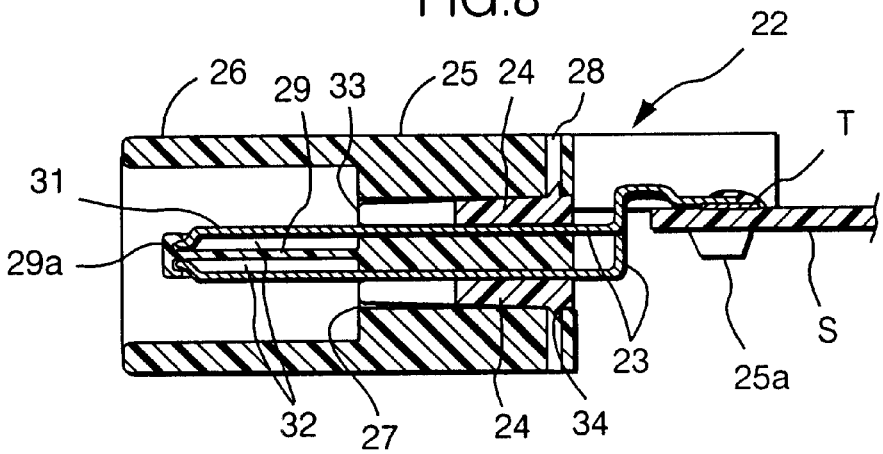
FIG. 8 is a cross-sectional view taken along VIII—VIII of FIG. 7.

A plug connector 21 according to a second embodiment of the present invention will be described below. As shown in FIG. 7, the plug connector 21 according to the second embodiment is mounted on the circuit board S, as with the receptacle connector 1, and has a case 22 and insertion contacts 23. As shown in FIG. 8, a fitting member 24 is fitted in the case 22.

The case 22 is molded of insulating synthetic resin injected into a mold(not shown). The case 22 comprises a body 25 with the insertion contacts 23 fixed therein and a hood 26 projecting forward from the body 25. As shown in FIG. 8, the body 25 has through holes 27 defined therein through which the insertion contacts 23 extend. As with the body 25 of the receptacle connector 1, the body 25 has engaging protrusions (not shown) in portions of the through holes 27 where the insertion contacts 23 are mounted. The body 25 has legs 25*a* on its rear portion for fixing the case 22 to the circuit board S. The hood 26 is of a laterally elongate tubular form which is open in its front face. The body 25 also has engaging holes 28 defined in rear inner walls thereof in which engaging projections 34 of the fitting member 24, to be described later on, engage.

An intermediate member 29 extends forward from a central portion of the body 25. The intermediate member 29 is interposed between the upper and lower insertion contacts 23 to insulate them from each other. The intermediate member 29 has a contact engaging portion 29*a* on its tip end for engaging the tip ends of the insertion contacts 23. As shown in a partly enlarged view in FIG. 7, the intermediate member 29 has partitions 30 each interposed between adjacent ones of the insertion contacts 23 that are juxtaposed in the transverse direction. In the present embodiment, the intermediate member 29 is integrally formed with the case 22.

The insertion contacts 23 are blanked out of a sheet of copper alloy which is a conductor, by a press. As shown in FIG. 8, the insertion contacts 23 have respective contact members 31 in the vicinity of their tip ends for contact with the reception contacts of the receptacle connector. The insertion contacts 23 also have engaging members (not shown) in their intermediate portions for engaging the engaging protrusions of the body 25, as with the receptacle connector. The insertion contacts 23 have respective rear ends soldered to terminals T on the circuit board S. In the present embodiment, gaps 32 are present between the reverse sides of the contact members 31 of the insertion contacts 23 and the intermediate member 29 for allowing the insertion contacts 23 to flex when they are brought into contact with the reception contacts 3 upon connection of the plug connector 21 to the receptacle connector 1.

Figure 9:
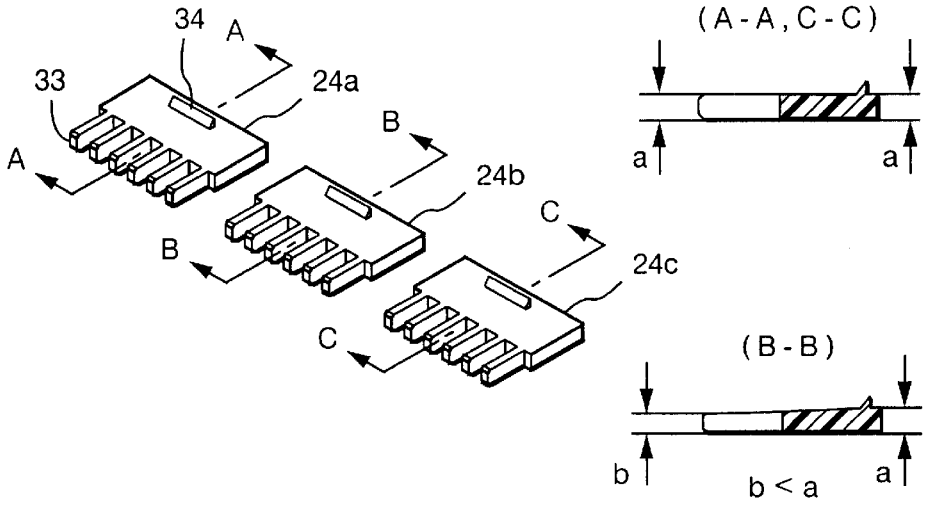
FIG. 9 is a set of views showing an external shape and cross-sectional shapes of a fitting member.

As shown in FIG. 8, the fitting member 24 is fitted between the insertion contacts 23 and the body 25. As shown in FIG. 9, the fitting member 24 comprises a collection of three members 24*a*, 24*b*, 24*c* that are assembled in the transverse direction. When the three members 24*a*, 24*b*, 24*c* are assembled together, the fitting member 24 has cross-sectional shapes corresponding to distortions of the case 22. Specifically, the left and right members 24*a*, 24*c* equal front and rear thicknesses a as shown in cross-sectional views taken along lines A—A, C—C of FIG. 9, whereas the central member 24*b* has an increased front thickness b smaller than the thickness a as shown in a cross-sectional view taken along line B—B of FIG. 9. The fitting member 24 has teeth 33 on its front portion as with the receptacle connector 1, with their upper and lower corners beveled on their tip ends. The fitting member 24 also has engaging ridges 34 on its rear upper surface portions for engaging in engaging recesses 28 defined in the body 25.

Figure 10A:
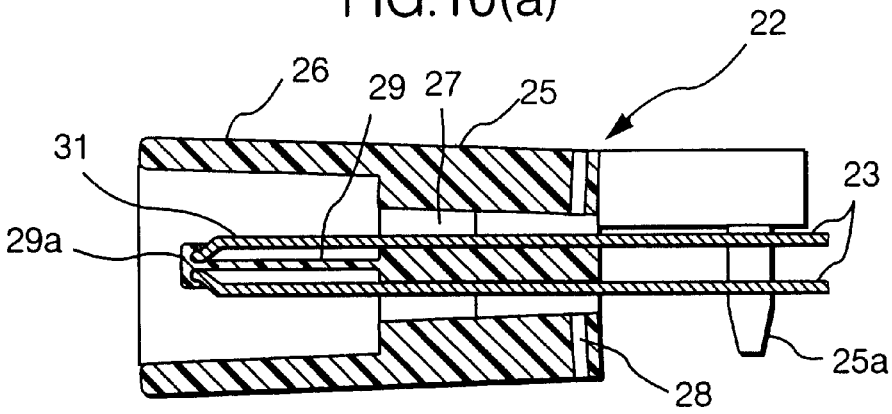
FIGS. 10(*a*) through 10(*c*) are views showing the manner in which the plug connector according to the second embodiment is assembled.
Figure 10B:
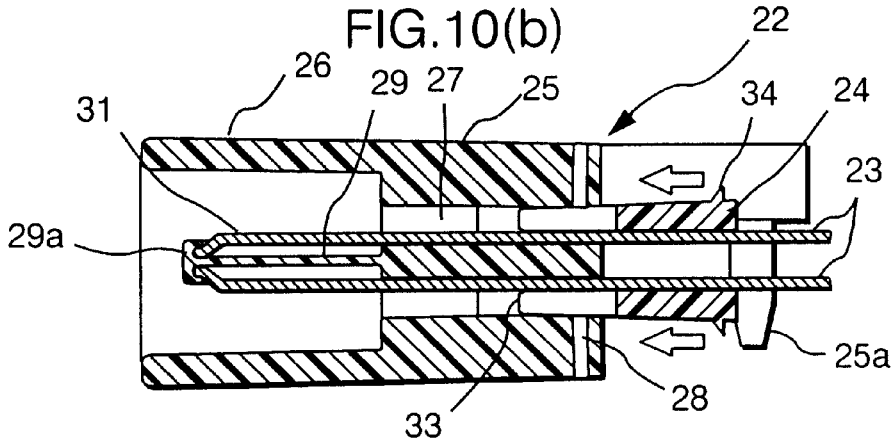
Figure 10C:
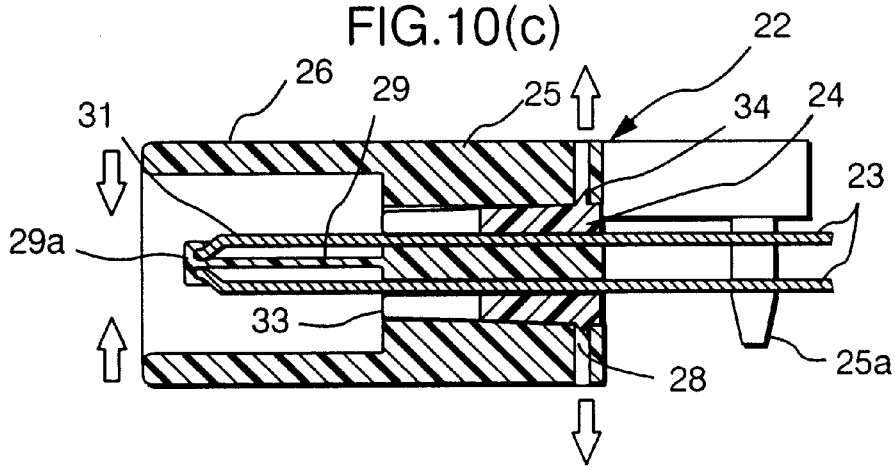

A process of correcting the hood 26 out of an outward distortion at its center which has been caused when the case 22 is placed alone as shown in FIG. 10(*a*) will be described below.

For assembling the plug connector 21 according to the present embodiment, as shown in FIG. 10(*a*), the insertion contacts 23 are inserted into the through holes 27 in the case 22 until their tip ends are inserted into the contact engaging portion 29*a*. The upper insertion contacts 23 are brought into contact with a lower inner wall surface of the case 22, and the lower insertion contacts 23 are brought into contact with an upper inner wall surface of the case 22. The engaging members (not shown) of the insertion contacts 23 are engaged by the engaging protrusions (not shown) in the case 22. Then, as shown in FIG. 10(*b*), with the fitting member 24 comprising upper and lower fitting members, the upper fitting member 24 is inserted between the upper insertion contacts 23 and an inner wall surface of the body 25, and fitted into the body 25, and the lower fitting member 24 is inserted between the lower insertion contacts 23 and an inner wall surface of the body 25, and fitted into the body 25. At this time, the upper fitting member 24 is fitted with the engaging ridges 34 being oriented upwardly, and the lower fitting member 24 is fitted with the engaging ridges 34 being oriented downwardly.

When the fitting member 24 is fully fitted in the case 22, as shown in FIG. 10(*c*), the teeth 33 of the fitting member 24 move into the through holes 27 until the engaging ridges 34 on the fitting member 24 engage in the engaging recesses 28 in the case 22. With the fitting member 24 being thus fitted in the body 25, the rear portion of the body 25 is spread by the fitting member 24, correcting the spread hood 26 into a normal state.

Since the fitting member 24 of the plug connector 21 according to the present embodiment is made up of three members 24*a*, 24*b*, 24*c*, even if the case 22 is differently distorted due to a different mold used to mold the case 22, members corresponding to the distortion of the case 22 may be selected and combined into the fitting member 24. In this manner, the case 22 may easily be corrected out of the distortion due to the mold without producing a new fitting member 24 of different shape.

In the above embodiment, the intermediate member 29 is integrally formed with the case 22. However, the intermediate member 29 may be prepared separately from the case 22.

In the embodiments, the receptacle connector 1 and the plug connector 21 are mounted on the circuit board S. However, the present invention is also applicable to receptacle and plug connectors mounted on ends of cables.

INDUSTRIAL APPLICABILITY

As described above, the present invention is useful as a connector for use with a cable which connects a circuit board used in a personal computer or the like or a personal computer or the like to a peripheral device.

What is claimed is:

1. A receptacle connector for connection to a plug connector, comprising:

a case made of an insulating synthetic resin, said case comprising a body having a plurality of through holes extending from a front face to a rear face thereof, and a tubular hood projecting forward from the body, said tubular hood having an open front face and an interior portion communicating with said through holes;

plural pairs of upper and lower reception contacts made of a conductor, inserted in said through holes, and disposed directly proximate to upper and lower inner wall surfaces of said hood without intervening elements; and a comb-shaped fitting member comprising a plurality of tooth members, said fitting member and said tooth members being fitted in said body between the pairs of upper and lower reception contacts for fixing said contacts to said case, wherein the tooth members of said fitting member have cross-sectional shapes to counteract a distortion of the hood, such that when said fitting member is installed in said body, the body is deformed to correct said distortion of the hood.

2. A connector according to claim 1, wherein at least two of said tooth members have different cross-sectional shapes.

3. A connector according to claim 2, wherein said different cross-sectional shapes are such that one of said tooth members is wider or narrower than another of said tooth members.

4. A connector according to claim 3, wherein at least one tooth member at a central position of said comb-shaped fitting member is wider than other tooth members at end positions of said fitting member.

5. A plug connector for connection to a receptacle connector, characterized by:

a case made of an insulating synthetic resin, said case comprising a body having a pair of upper and lower through holes extending from a front face to a rear face thereof, a tubular hood projecting forward from the body, said tubular hood having an open front face and an interior portion communicating with said through holes, and an intermediate member projecting from said body into said hood and separating an interior of the hood into upper and lower spaces;

plural pairs of upper and lower insertion contacts made of a conductor, inserted in said through holes, and disposed directly proximate to upper and lower surfaces of said intermediate member without intervening elements; and a pair of upper and lower comb-shaped fitting members comprising a plurality of tooth members, said fitting members and said tooth members being fitted between said insertion contacts and said body for fixing said contacts to said case, wherein the tooth members of said fitting members have cross-sectional shapes to counteract a distortion of the hood, such that when said fitting members are installed in said body, the body is deformed to correct said distortion of the hood.

6. A connector according to claim 5, wherein at least two of said tooth members have different cross-sectional shapes.

7. A connector according to claim 6, wherein said different cross-sectional shapes are such than one of said tooth members is wider or narrower than another of said tooth members.

8. A connector according to claim 7, wherein said comb-shaped fitting member comprises a plurality of comb-shaped fitting members, wherein ends of respective comb-shaped fitting members are disposed adjacent to each other.

9. A connector according to claim 8, wherein the tooth members of one of said plurality of comb-shaped fitting members are narrower than the tooth members of another of said plurality of comb-shaped fitting members.

10. The connector according to claim 9, wherein each of said upper and lower fitting members comprises three adjacently disposed comb-shaped fitting members, wherein a central fitting member among said three comb-shaped fitting members has tooth members which are narrower than the tooth members of other adjacent comb-shaped fitting members.

* * * * *